US005217428A

United States Patent [19]

Schlip et al.

[11] Patent Number: 5,217,428

[45] Date of Patent: Jun. 8, 1993

[54] WEIR FOR SETTING THE LIQUID LEVEL IN SOLID BOWL CENTRIFUGES

[75] Inventors: Reinhold Schlip, Woerthsee; Wolfgang Epper, Bergheim, both of Fed. Rep. of Germany

[73] Assignee: Kloeckner-Humboldt-Deutz Aktiengesellschaft, Fed. Rep. of Germany

[21] Appl. No.: 546,918

[22] Filed: Jun. 29, 1990

[30] Foreign Application Priority Data

Jun. 29, 1989 [DE] Fed. Rep. of Germany ..... 3921327

[51] Int. Cl.[5] ..... B04B 11/00

[52] U.S. Cl. ..... 494/56; 494/53

[58] Field of Search ..... 494/2, 3, 47, 48, 52–54, 494/56, 57; 366/184, 192, 193; 210/360.1, 360.2, 369, 371, 540, 781, 787

[56] References Cited

U.S. PATENT DOCUMENTS

| | | | |
|---|---|---|---|
| 1,864,818 | 6/1932 | Haug | 210/360.1 X |
| 3,081,026 | 3/1963 | Lacker et al. | 494/53 X |
| 3,092,582 | 6/1963 | Lacker | 494/53 X |
| 3,532,264 | 10/1970 | Amero | 494/53 X |
| 3,580,492 | 5/1971 | Schnittger et al. | 494/53 |
| 3,858,794 | 1/1975 | Nilson et al. | 494/53 X |
| 3,967,778 | 7/1976 | Hunwick | 494/53 X |
| 4,339,072 | 7/1982 | Hiller | 494/56 X |
| 4,378,906 | 4/1983 | Epper et al. | 494/53 X |
| 4,406,652 | 9/1983 | Nielsen | 494/56 |
| 4,575,370 | 3/1986 | La Montagne | 494/56 |
| 4,764,163 | 8/1988 | Caldwell | 494/56 |
| 4,784,634 | 11/1988 | Schiele | 494/56 X |
| 4,950,219 | 8/1990 | Luchetta | 494/53 |

FOREIGN PATENT DOCUMENTS

| | | | |
|---|---|---|---|
| 391043 | 10/1990 | European Pat. Off. | 494/53 |
| 2419355 | 11/1975 | Fed. Rep. of Germany | 494/53 |
| 3728901 | 11/1988 | Fed. Rep. of Germany . | |
| 270475 | 8/1989 | Fed. Rep. of Germany | 494/53 |
| 3822983 | 1/1990 | Fed. Rep. of Germany | 494/53 |
| 3904151 | 8/1990 | Fed. Rep. of Germany | 494/53 |

*Primary Examiner*—Harvey C. Hornsby
*Assistant Examiner*—Charles Cooley
*Attorney, Agent, or Firm*—Hill, Steadman & Simpson

[57] ABSTRACT

An apparatus for controlling the level of liquid in a centrifugal separator drum by regulating the flow of liquid out of the drum. The drum includes a plurality of circumferentially spaced openings in a radial end wall of the drum. The openings have movable weir plates in one form controlling the openings with the weir plates movable and positionable in a radial direction by axially movable linkage. In another form, a conduit passage leads from an end opening. By controlling the flow through the openings in the end wall, the liquid level is functionally controlled within the drum. The control mechanisms are situated externally of the drum for ease of repair and to provide control which can be continually monitored.

5 Claims, 4 Drawing Sheets

WEIR FOR SETTING THE LIQUID LEVEL IN SOLID BOWL CENTRIFUGES

BACKGROUND OF THE INVENTION

The present invention is directed to improvements in solid bowl centrifuges, and more particularly to a method and mechanism for adjustably controlling the liquid level in the centrifuges. More particularly, the improvement relates to a solid bowl centrifuge with openings in an end radial wall and weir elements positioned relative to the openings and movable for restricting the size of the opening to thereby set the liquid level to a predetermined height within the centrifuge drum.

In the process of separation in a solid bowl centrifuge, in order to obtain optimum separating results particularly with slurries that are difficult to separate and to convey, it is expedient to obtain a predetermined exact liquid level in the separating space of the centrifuge and to preserve and maintain that level. An exact setting of the pool height of the liquid in the centrifuge is required to avoid misdischarges when starting up and stopping the centrifuge.

German Patent 37 28 901 discloses a centrifuge construction wherein a weir is employed for controlling the liquid level in a solid bowl centrifuge. In the drum of this worm centrifuge are two weir disks arranged at a distance from one another. Radially extending discharge channels can be closed with an axially movable slide arranged between weir disks. Control chambers are charged with a control agent from outside of the drum by channels connected to the slide.

Although predetermined liquid levels can be set with this known weir construction during operation of the separator drum, the structural arrangement of this known setting mechanism is relatively complicated and is difficult to access for adjustment or repair should that become necessary, since the structure is situated in the interior space of the centrifugal drum. Further, the delivery of the control fluid to the slide which is arranged inside the centrifuge is difficult to control and encounters sealing problems, particularly in the region of a rotary transmission lead-through connection.

It is accordingly an object of the present invention to provide a structure and method of controlling the level of liquid in a solid bowl centrifuge which is not only simple in structural design but particularly which can be monitored and controlled from outside of the drum during separation operation.

A further object of the invention is to provide an improved structure for a solid bowl centrifuge wherein a weir is employed controlling a liquid flow outlet to thereby control the level of separating liquid within the drum.

A further object of the invention is to provide an improved solid bowl separator construction which is capable of more continuous operation without attention and which performs an improved separation operation.

FEATURES OF THE INVENTION

The foregoing objects are accomplished in that the adjustment elements for the liquid discharge are located outside of the centrifuge drum. These adjustment elements are operated by an adjustment means which is located outside of the centrifuge drum. As a result, the maintenance and function monitoring of the adjustment elements are considerably facilitate. Also, the replacement of worn adjustment elements by new adjustment elements is simplified. The centrifuge drum need not be dismantled and opened for this purpose.

Additionally, sealing problems are completely avoided in that the adjustments elements are arranged to be connected by mechanical connector elements with an adjustment means arranged outside of the drum. By contrast, known centrifuges have complicated and expensive bores in the drive shaft and in the end wall of the drum which are the adjustment elements. These undesirable structures are eliminated. This leads to a considerable reduction in the manufacture and maintenance costs required for apparatus to set the liquid level in solid bowl centrifuges.

In one arrangement a development of the structure involves a ring which is axially displaceable on the drive shaft of a centrifuge drum. This adjustments means is also distinguished particularly by its simple structural design and high operating reliability.

Other objects, advantages and features of the invention will become more apparent with the teaching of the principles thereof in connection with the disclosure of the preferred embodiments in the specification, claims and drawings in which:

DESCRIPTION OF THE PREFERRED EMBODIMENTS

Figure 1:
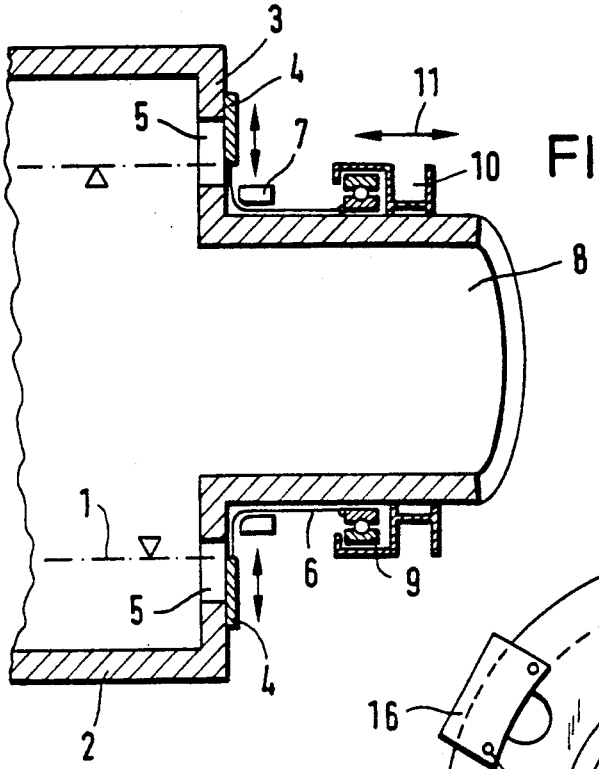
FIG. 1 is a fragmentary view in axial section of an end of a centrifugal drum embodying the principles of the present invention.

FIG. 1 illustrates one end of a centrifugal separator drum 2 having a radial end wall 3. The drum is of a construction which will be well known to those versed in the art having an inlet for effluent to be separated. The drum will have an outlet for the heavier phase material and a plurality of circumferentially spaced openings 5 for liquid. Suitable means are arranged to drive the drum in rotation and various internal constructions may be employed such as screw conveyors with a construction that requires the separated liquid to be maintained at an optimum level, shown at 1, for effective efficient operation.

To maintain the liquid level 1 at a predetermined height within the drum, radially movable weirs 4 are provided for each of the openings.

The weirs are uniquely controlled by cables which attach thereto and which are guided by an annular ring 7 with the cables extending axially and connected in a radial direction to the weirs to control their radial position and thereby control the effective flow size of the openings 5. The radial location of the weirs 4 will adjustably determine the level 1 of the liquid within the drum.

The adjustment cables 6 are connected at their outer ends to an annular control 9. The annular control is operated by an adjustment ring 10 which moves axially and the construction of the part 9 is that of a ball bearing which allows the control 10 to be rotationally stationary and yet permits the drum to rotate on its drive shaft 8.

The construction shown permits axial movement of the control 10 in the direction indicated by the arrowed line 11 to position the radial location of the weirs 4. It is to be noted that the entire adjustment mechanism is externally of the drum which accommodates ease of repair and adjustment even during operation. Being externally located, it is not contaminated by the contents of the drum.

The adjustment means 10 can be of different mechanical designs and may be a double acting hydraulic or pneumatic piston cylinder unit where the piston rod is attached to the annular adjustment ring 10. Another construction will involve a toothed rack having an adjustment pinion or screw spindle so that the adjustment ring can be employed as the adjustment means, being located externally and permitting adjustment by simple axial movement of the control 10.

When setting the liquid level in the centrifuge drum 2, the plate shaped adjustment weir elements 4 are moved in a radial direction by axially displacing the adjustment ring 10 which creates an axial force on the annular bearing 9 to move the tension cable 6 in either direction depending upon the axial direction which the ring 10 is moved as indicated by the arrowed line 11. With displacement of the adjustment ring 10 toward the left as shown in FIG. 1, the weir plates 4 are moved radially outwardly to increase the effective flow size of the adjustment openings 5 and thereby reduce the liquid level 1 of the liquid inside the drum. With a controlled movement of the ring 10 to the right, as shown in FIG. 1, the discharge openings 5 are closed by the radial inward movement of the weir plates 4. This increases the liquid level 1 of the liquid within the drum. The level of the liquid can be regulated with infinite variability in a very simple way during operation of the centrifuge and can be mounted at any time from the outside and automatically optimally set in accordance with the substances to be separated from one another in the centrifuge. The level of the liquid 1 is controlled as a function of the axial position of the control ring 10.

Figure 2:
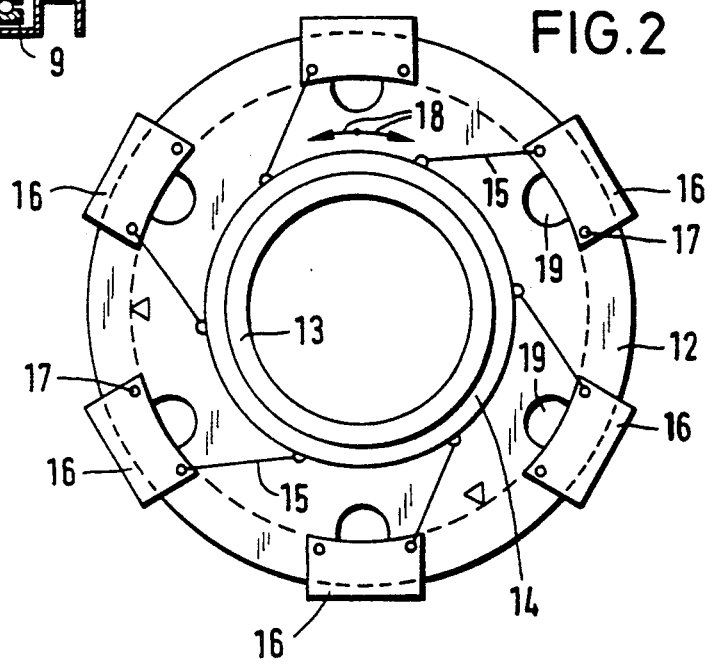
FIG. 2 is an end elevational view.

FIG. 2 illustrates a modified construction wherein the liquid level is controlled by a rotatable control ring 14. An end wall for the drum is shown at 12 having a plurality of openings 19 therein. The openings are partially covered by pivotal plates 16 pivoted at one corner 17. The free ends of the plates are connected by control rods 15 which push the plates into pivotal movement as the control ring 14 is rotated one way or the other as indicated by the arrowed line 18.

When the control ring 14 of FIG. 2 is rotated counter-clockwise on the drum shaft 13, the rods 15 pivot the plates to cover more of the openings 19 and thereby increase the level of liquid inside the drum. When the control ring 14 is rotated clockwise, the rods 15 pivot the plates to increase the effective size of the openings 19 to thereby lower the level of the liquid within the drum.

Figure 3:
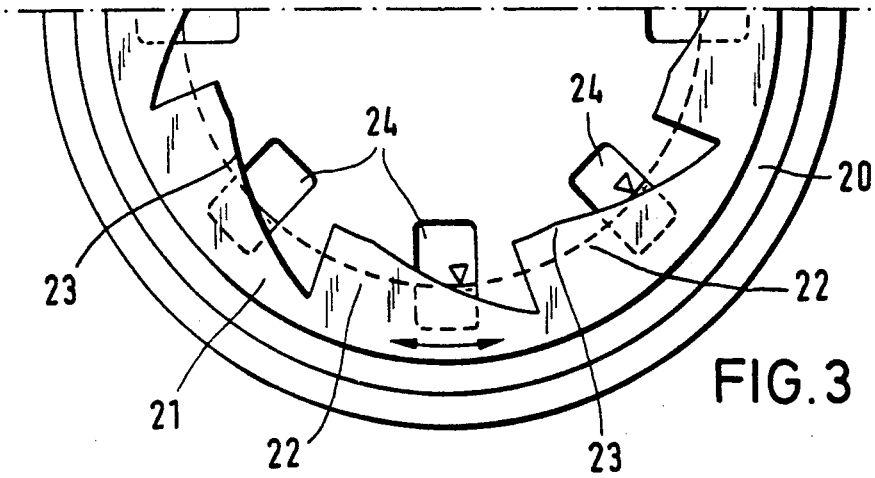
FIG. 3 is one-half of an end elevational view.

FIG. 3 shows a modification wherein openings can be controlled by a single rotatable ring. In FIG. 3, a drum end wall has a plurality of circumferentially spaced openings 24. These openings are partially covered by surface portions 22 of an annular ring 21. The ring is supported on an annular enclosing support 20. The ring 21 is serrated and has angular or tapered portions 23 which extend across the openings 24 so that as the ring 2; is rotated, the amount that the angular portions 23 cover the openings 24 will be changed. For example, as the ring 21 is rotated in a counter-clockwise direction, more of the openings 24 will be closed to increase the level of liquid inside the drum. As the ring 21 is rotated in a clockwise direction, the effective flow area of the openings 24 will be increased to lower the level of the liquid within the drum.

Figure 4:
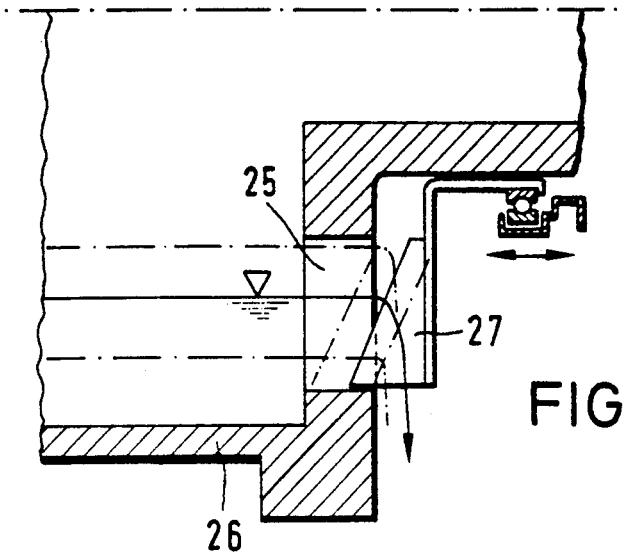
FIG. 4 is a fragmentary axial sectional view of a centrifugal separator.

In the arrangement of FIG. 4, a portion of a drum is shown with an end wall having a plurality of openings 25 therein to release liquid from the drum and the effective size of the openings 25 will control the liquid level within the drum 26. In each of the openings is a wedge shaped plug 27 which is movable axially. Moving the plug 27 to the left to the broken line position will decrease the size of the opening and thereby increase the level of liquid in the drum. Moving the wedge 27 to the right will increase the effective size of the opening to permit more liquid to flow from the drum and thereby lower the level of liquid in the drum. In this construction as in the other constructions shown, the operating control mechanism is externally of the drum and is operated readily b axial movement of the control.

Figure 5:
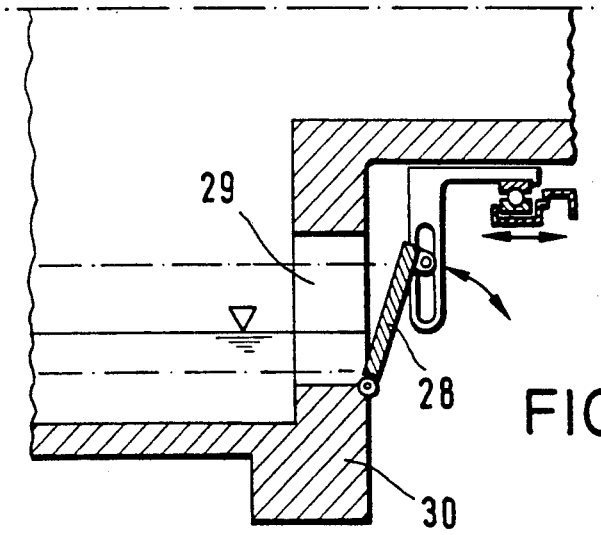
FIG. 5 is a fragmentary axial sectional view of a centrifugal separator.

In FIG. 5 a drum 30 is shown with an end wall and openings 29 therein. In each of the openings is a door or gate 28 which is pivotally mounted. The pivotal position of the gate is controlled by axial movement of its control to either increase or decrease of the size of the opening 29 and thereby control the level of liquid within the drum.

In FIGS. 6 through 10, a separate and unique manner of controlling the size of an opening from the drum is illustrated. In the respective Figures, the openings in the end wall of the drum are shown at 36, 37, 38, 39 and 40.

Figure 6:
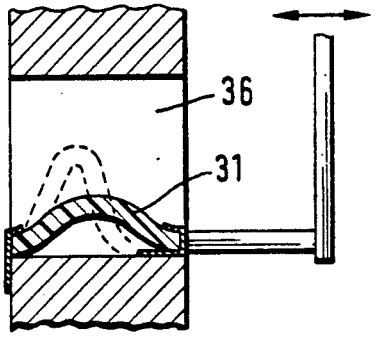
FIGS. 6 through 11 are fragmentary sectional views illustrating liquid flow openings in the end wall of a separator with various inflatable arrangements for controlling the opening size, embodying the principles of the invention.

In FIG. 6, positioned in the opening is a flexible diaphragm 31 which moves from the solid to the dotted line position as its control lever is moved to the left thereby decreasing the effect of flow size of the opening 36. The control for the diaphragm moves to the left or right as indicated by the arrowed line.

Figure 7:
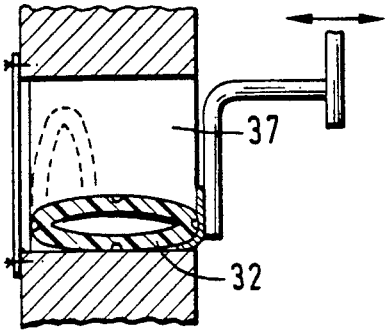

In FIG. 7, a doubled wall diaphragm 32 is shown in the opening 37. This diaphragm moves between the solid line and dotted line position a its control is moved to the left or right to thereby decrease or increase the effective size of the opening 37.

Figure 8:
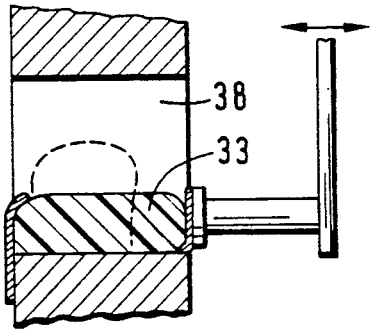

In FIG. 8, a solid heavy diaphragm 33 is shown in position to block the opening 38. As its control is moved to the left to compress the diaphragm 33, it bulges up to the dotted line position to decrease the size of the opening 38 and thereby restrict the flow and increase the level of liquid in the drum. As the control is moved to the right, the diaphragm moves to the solid line position increasing the size of the opening and decreasing the level of liquid in the drum.

Figure 9:
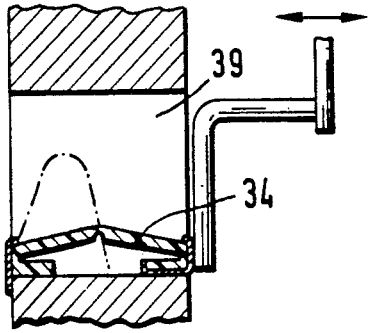

FIG. 9 illustrates an arrangement where a hinged diaphragm 34 is shown which doubles at its center which has a groove to insure bending at that location. As the control is moved to the left, the double wall diaphragm 34 doubles to the position shown by the broken line to thereby restrict the size of the opening 39. As the control is moved to the right, the blocking mechanism 34 pivots down to the solid line position to increase the size of the opening and lower the level of the liquid in the drum.

Figure 10:
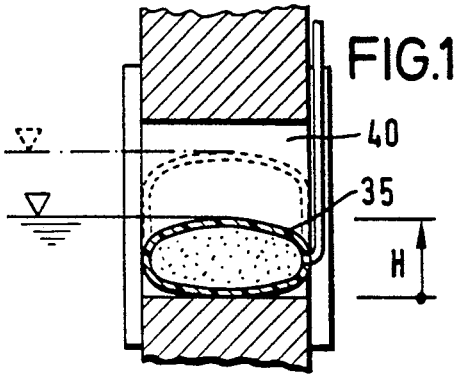

FIG. 10 illustrates an inflatable diaphragm 35 having a inflation tube leading to its interior. The interior is pressurized by air or liquid so that it increases in size from the solid to the dotted line position. This will increase the level of liquid in the drum. Also, releasing the pressure of the fluid in the diaphragm will decrease the liquid level in the drum.

Figure 11:
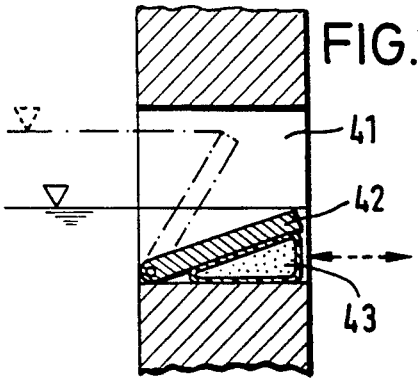

FIG. 11 illustrates another modification wherein a flap or gate 42 is pivotally positioned within an opening 41. The gate is activated or moved from the solid to the dotted line position by an inflatable bellows 43 underneath the gate. Directing pressurized fluid to the bellows 43 will force the gate to restrict the size of the opening 41 to thereby increase the level of liquid in the drum. Releasing pressure within the inflatable member 43 will permit the gate to move toward the solid line position to thereby decrease the level of liquid within the drum.

Figure 12:
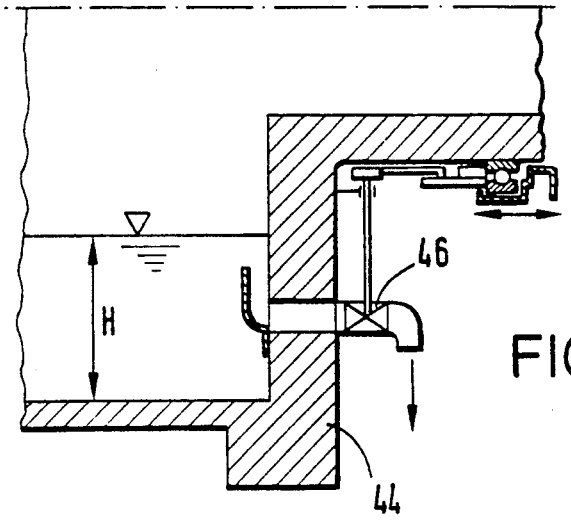
FIG. 12 is a fragmentary axial sectional view of a separator illustrating a conduit for controlling the liquid flow from the separator.
Figure 13:
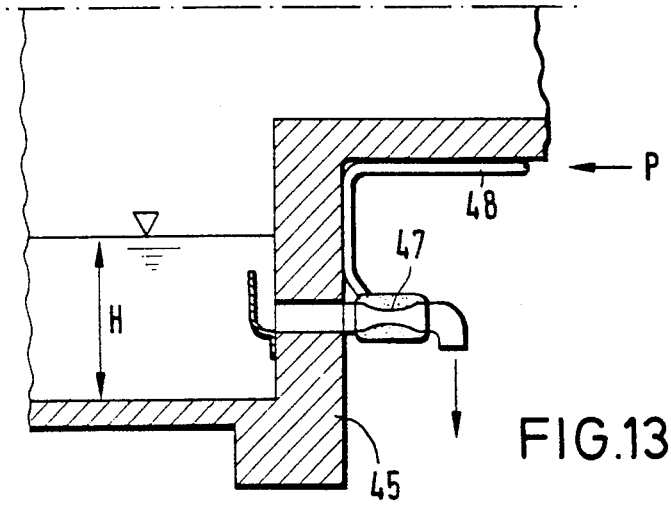
FIG. 13 is a fragmentary axial sectional view illustrating another form of controlled conduit for the liquid flow.

In the arrangement of FIGS. 12 and 13, openings are shown in the end walls of drums 44 and 45 which have a pipe or conduit connected thereto.

In FIG. 12, the conduit has a control valve 46 therein which can be controlled externally to restrict the size of the conduit and thereby limit the flow from the drum. In this arrangement, the opening does not directly control the level of the liquid but merely functions to lead off a controlled amount of liquid to thereby control the height H of liquid in the drum.

In the arrangement of FIG. 13, a valve arrangement 47 for a conduit leading from the interior of the drum is provided with the valve arrangement being in the form of a throttle valve or a pinch valve. This arrangement can have a hydraulic or pneumatic inflation construction to controllably restrict the size of the conduit leading from the interior of the drum to thereby control the height H of the liquid in the drum. The amount of constriction of the conduit is controlled by the pressure P directed through a control line 48.

In each of the arrangements of FIGS. 12 and 13, it is preferred that a baffle be positioned opposite the opening to permit uniform flow and to prevent surges out through the conduit.

Figure 14:
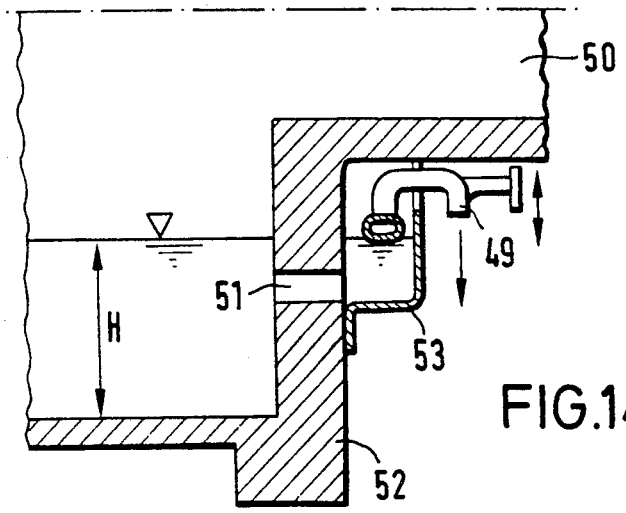
FIG. 14 is a fragmentary axial sectional view illustrating a skimmer arrangement for controlling the flow from the separator.

In FIG. 14, a skimmer arrangement is provided for an end wall 52 of a drum. A passage 51 through the end wall leads to a chamber 53 which receives liquid flowing from the drum. In the chamber is an open skimmer pipe 49 which acts as a skimmer to skim the top off the liquid in the chamber. The skimmer pipe 49 can be moved radially as indicated by the double arrowed line to control the level of liquid in the chamber 53 and to thereby control the height H of liquid in the drum 50.

In each of the arrangements shown, control mechanism are located externally of the drum which permit and accommodate control during operation of the drum. These arrangements also permit simple replacement and repair of elements needed for the control.

Thus, it will be seen there has been provided a new and unique liquid control arrangement for a centrifugal separator drum which meets the objects and advantages above set forth and which accomplishes an improved simplified mechanical construction as well as improving the separation operation of the drum.

We claim as our invention:

1. A centrifugal separator for separating a heavier element from a liquid comprising in combination:

a separator drum rotatable about an axis and having a liquid discharge end wall extending radially at a right angle to the axis of the drum with a plurality of axial liquid discharge openings in the end wall for discharging liquid so that the liquid in the separator drum is maintained at a predetermined level;

weir means partially blocking said liquid discharge openings and being movable to controllably change the liquid level in the drum by changing the amount that the openings are blocked;

and adjustment means capable of adjusting the weir means while the drum is rotating and being connected to the weir means, said adjustment means being located externally of the drum and operable during drum rotation so that the weir means can be adjustable moved from a location external of the drum during a separation operation;

said adjustment means including an annular ring coaxial with the drum and axially displaceable for adjustment of the weir.

2. A centrifugal separator for separating a heavier element from a liquid constructed in accordance with claim 1:

wherein said weir means are in the form of individual plates with each plate adjustably controlling a size of one of said openings.

3. A centrifugal separator for separating a heavier element from a liquid constructed in accordance with claim 1:

wherein said weir means are in the form of individual adjustable elements which are wedge shaped and are movable relative to the openings to change an effective flow size of the openings.

4. A centrifugal separator for separating a heavier element from a liquid constructed in accordance with claim 1:

wherein the weir means includes a flap pivotally mounted on the wall and pivoting to control an effective size of an opening.

5. A centrifugal separator for separating a heavier element from a liquid constructed in accordance with claim 1:

wherein the weir means is in the form of a wedge partially mounted into an opening and axially movable to control a remaining effective discharge size of the opening.

* * * * *